United States Patent [19]

Hancock

[11] 4,417,673

[45] Nov. 29, 1983

[54] SPRAY DISPENSER FOR A CONTAINER OF A FLUID UNDER PRESSURE

[75] Inventor: Warren J. Hancock, Clayton, Australia

[73] Assignee: The Commonwealth Industrial Gases Limited, Surry Hill, Australia

[21] Appl. No.: 290,235

[22] Filed: Aug. 5, 1981

[30] Foreign Application Priority Data

Aug. 13, 1980 [AU] Australia ..... PE5007

[51] Int. Cl.[3] ..... B65D 83/14

[52] U.S. Cl. ..... 222/153; 222/402.13

[58] Field of Search ..... 222/402.13, 402.14, 222/402.15, 402.25, 174, 402.11, 471, 153; 239/333

[56] References Cited

U.S. PATENT DOCUMENTS 3,848,778 11/1974 Meshberg ..... 222/402.11

FOREIGN PATENT DOCUMENTS 494198 6/1978 Australia .

*Primary Examiner*—Stanley H. Tollberg

*Attorney, Agent, or Firm*—Merriam, Marshall & Bicknell

[57] ABSTRACT

A spray dispenser for a container of a fluid under pressure, having a schrader type discharge valve; consists of a handpiece removably secured on the container and having a spray discharge nozzle in tubular connection with the valve, a movable trigger mounted on the handpiece and connected to the valve so that the trigger is operable to open the valve against the influence of a spring forming part of the valve, and an interlock lever fulcrumed on the handpiece, which is resiliently influenced to obstruct movement of the trigger but is hand-releasable to permit such movement.

7 Claims, 8 Drawing Figures

SPRAY DISPENSER FOR A CONTAINER OF A FLUID UNDER PRESSURE

This invention relates to the fine spray dispensation of fluids; particularly those of the kind referred to in our prior Australian patent No. 494,198.

The fluids may be insecticides, pesticides, deodorants or the like, and they are customarily stored under pressure in containers known as cylinders or bottles.

The containers are usually in the form of cylindrical bodies having hemispherical ends, and at one end they are provided with a neckpiece having an opening in it fitted with a normally-closed depressibe-stem contents-discharge valve. An example of such a valve is that used on pneumatic tyres and commonly known as a "schrader" valve.

The object of the invention is to provide a simple dispenser unit which is readily applicable to and removable from a container of the kind indicated, is convenient to use and incorporates simple interlock means to prevent non-deliberate discharge of fluid while being self-locking when discharge is not wanted.

The invention provides, a sprayable-fluid dispenser for a container of the kind consisting of a body having a contents discharge neckpiece fitted with a normally-closed depressible-stem discharge valve; comprising:

(a) a skirt adapted for removable attachment to the container neckpiece;

(b) a handpiece secured on said skirt;

(c) an operating trigger on said handpiece, movable between an "off" position and an "on" position;

(d) a fluids issue nozzle on said handpiece;

(e) mechanism within said handpiece and said skirt whereby placement of said trigger in its on position causes depression of said stem thereby to put said nozzle in communication with the interior of said body;

(f) interlock means on said handpiece having a locked position in which movement of said trigger from its off position is obstructed, and an unlocked position in which such movement is unobstructed;

(g) first spring-loading means which influence said trigger to remain in its off position; and (h) second spring-loading means which influence said interlock means to reamin in locked position.

An example of the invention is illustrated in the drawings herewith.

Figure 1:
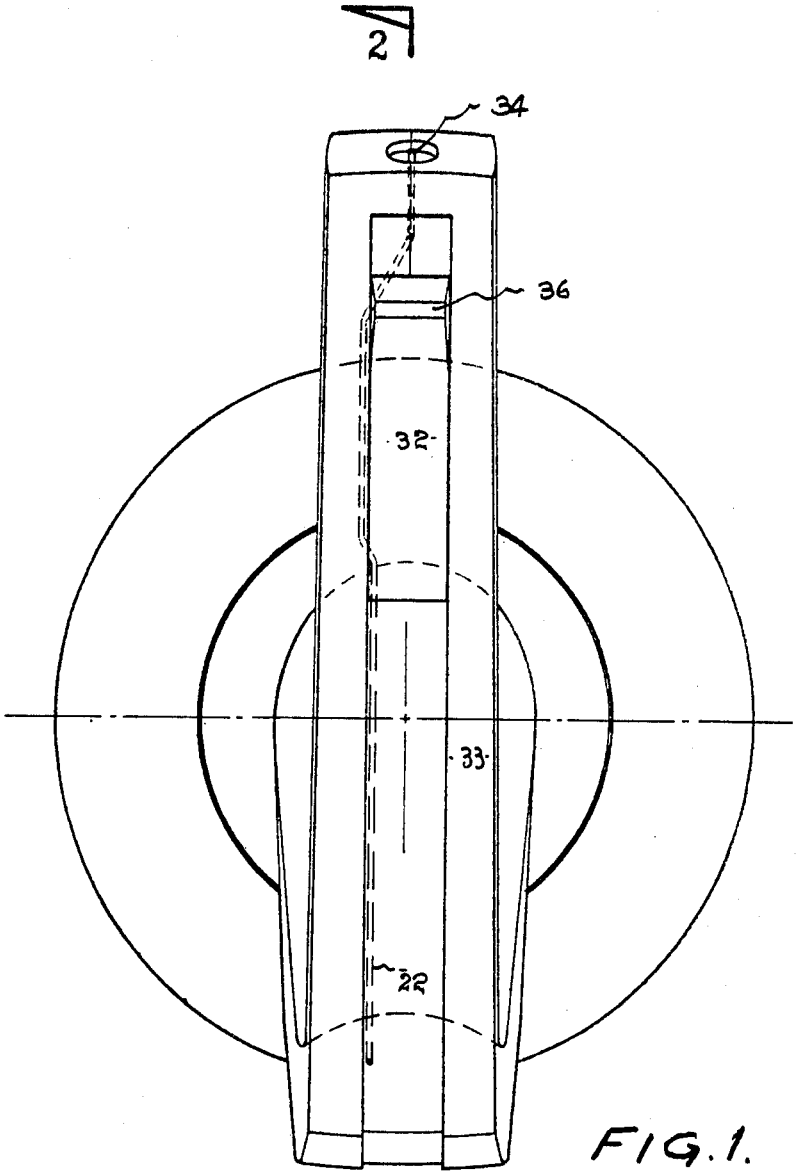
FIG. 1 is a plan of a dispenser.

Referring to the drawings, a container body is indicated at 9. It has a neckpiece 10 fitted with an issue valve (not shown) having a depressible stem 11. This stem projects into a counterbore 12 internally threaded at 13 to receive a screw-in plug 14. Plug 14 depends from a mounting plate 15, and this, for preference, has a sleeve 16 secured on it. This sleeve is able to home within an annular cavity 17 formed in the neckpiece 10 as a precautionary measure to ensure that the plug is being applied to a container suited thereto.

Plug 14 houses a longitudinally movable plunger 18 axially aligned with the depressible stem 11. This plunger is loaded by a spring 19 which influences the plunger to remain retracted from stem 11.

Plunger 18 fits within plug 14 with sufficient looseness to permit fluid flowing from the body 9 to pass through the plug, through a filter, indicated at 20, to the intake end 21 of a fluid feed tube 22.

Figure 8:
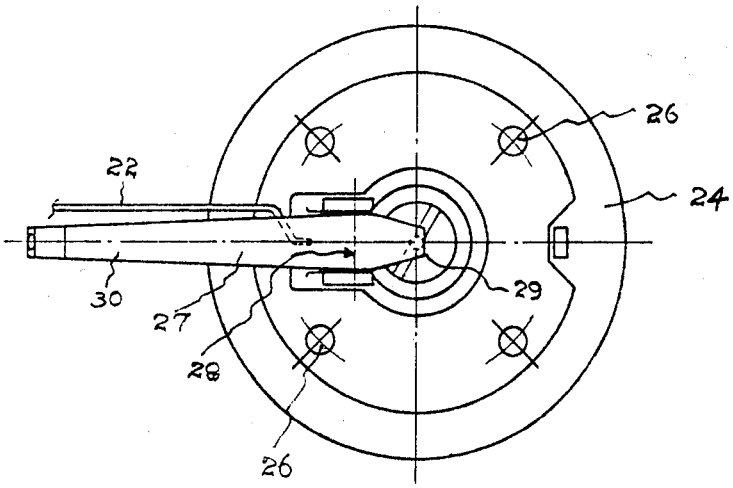
FIG. 8 is a partial plan taken on line 8—8 in FIG. 2.

Skirt 23 and the base plate 24 of a handpiece 25 are secured to mounting plate 15 by way (for example) of screws indicated at 26 in FIG. 8.

A lever 27, fulcrumed on the handpiece at 28, has one end 29 which bears against the outer end of plunger 18. The other end 30 of the lever is in the form of a tailpiece connected by a substantially in-extensible thong 31 to a trigger 32.

The handpiece 25 has a grip portion 33. Tube 22 extends through this portion to end in an issue nozzle 34.

Figure 2:
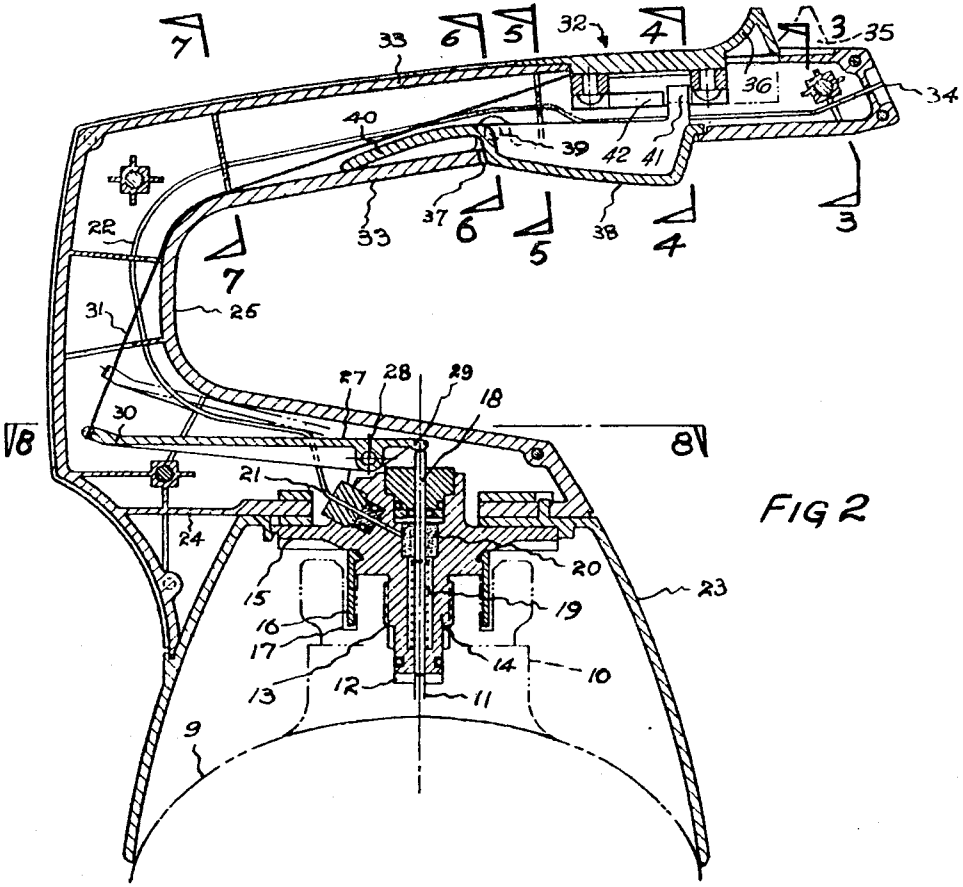
FIG. 2 is a sectional side elevation taken on line 2—2 in FIG. 1.
Figure 3:
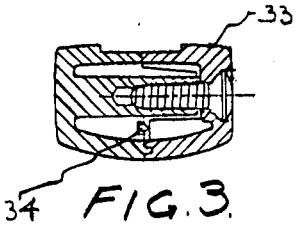
FIGS. 3 to 7 are sectional end views respectively taken on lines 3—3, 4—4, 5—5, 6—6 and 7—7 in FIG. 2.
Figure 4:
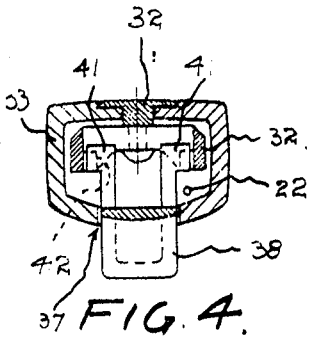
Figure 5:
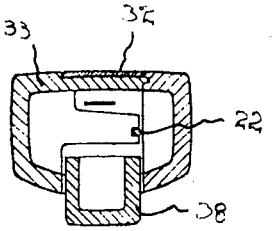
Figure 6:
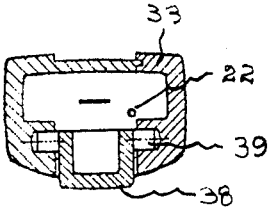
Figure 7:
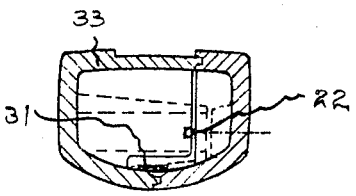

Trigger 32 is longitudinally and slidably mounted on portion 33 so that it is movable between its off position, (as indicated by full lines in FIG. 2) and its on position as indicated by dotted lines 35. Trigger 32 has a thumb abutment 36 by which a user of the dispenser may, by thumb pressure, move the trigger from its off position to its on position. The trigger automatically reverts to off position, upon relaxation of thumb pressure, by reason of the loading effect of spring 19 working through plunger 18, lever 28 and thong 31.

Portion 33 has a hole 37 in it through which a portion of a finger-depressible interlock lever 38 obtrudes. This lever is fulcrumed on portion 33 at 39 and has a tailpiece 40 which is sufficiently resilient to act as a loading spring whereby lever 38 is influenced to remain in its locked postion as shown. Lever 38 also carries a pair of obstruction lugs 41 which, when the trigger is in off position and the lever 38 is in locked position, lie in the movement path of a pair of stops 42 on the trigger, thus to prevent movement of the trigger towards its on position.

When fluid is to be discharged, the user first depresses lever 38 with his gripping fingers. This raises lugs 41 so that stops 42 may then move unobstructedly under the lugs, so permitting thumb pressure on the trigger to move it into its on position. When this movement of the trigger occurs, thong 31 hauls upon lever 28 so to depress plunger 18 and so cause fluid to pass from body 9, through tube 22 for discharge at nozzle 34.

I claim:

1. A sprayable-fluid dispenser for a container of the kind having a body having a contents discharge neckpiece fitted with a normally-closed depressible-stem discharge valve; comprising:

(a) a skirt adapted for removable attachment to the container neckpiece;

(b) a handpiece comprising:

(1) a neck portion extending vertically above said skirt and having its lower end contiguous with said skirt; and (2) a grip portion contiguous with said upper end of said neck portion and spaced above and extending transversely across said skirt;

(c) an operating trigger on said handpiece, movable between an "off" position and an "on" position;

(d) a fluids issue nozzle on said handpiece;

(e) mechanism within said handpiece and said skirt whereby placement of said trigger in its on position causes depression of said stem thereby to put said nozzle in communication with the interior of said body;

(f) interlock means on said handpiece having a locked position in which movement of said trigger from its off position is obstructed, and an unlocked position in which such movement is unobstructed;

(g) first spring-loading means which influence said trigger to remain in its off position; and (h) second spring-loading means which influence said interlock means to remain in locked position.

2. A dispenser according to claim 1 wherein said operating trigger is slidably mounted on said handpiece for movement longitudinally thereof.

3. A dispenser according to claim 2 wherein said mechanism comprises:

a lever fulcrumed on said handpiece whereof one arm bears against said stem and whereof the other arm is in the form of a tail-piece; and a substantially inextensible thong whereof one end is connected to said tail-piece and the other end is connected to said trigger.

4. A dispenser according to claim 1 wherein said nozzle communicates with the interior of said body by way of a feed tube housed wholly within said handpiece.

5. A dispenser according to claim 2 wherein said interlock means comprise:

an interlock lever fulcrumed on said handpiece and having a portion which obtrudes externally of said handpiece through a hole therein;

at least one obstruction lug on said interlock lever which normally projects into the movement path of said trigger; and a stop on said trigger whereof movement is normally prevented by said obstruction lug.

6. A dispenser according to claim 3 wherein said first spring-loading means consist of a spring forming part of said discharge valve.

7. A dispenser according to claim 5 wherein said second spring-loading means consist of a resilient tail-piece forming part of said interlock lever.

* * * * *